US005121723A

United States Patent [19]

Stepper et al.

[11] Patent Number: 5,121,723

[45] Date of Patent: Jun. 16, 1992

[54] ENGINE BRAKE CONTROL APPARATUS AND METHOD

[75] Inventors: Mark R. Stepper; Gregory R. White, both of Columbus; Jeffrey P. Seger, Greenwood; Douglas VanKlompenburg, Columbus, all of Ind.; James H. Green, Manhattan Beach, Calif.; Richard Ling, Scottsdale, Ariz.

[73] Assignee: Cummins Electronics Company, Inc., Columbus, Ind.

[21] Appl. No.: 677,651

[22] Filed: Mar. 29, 1991

[51] Int. Cl.[5] ..... F02D 13/04

[52] U.S. Cl. ..... 123/322

[58] Field of Search ..... 123/90.15, 90.16, 320, 123/321, 322, 323

[56] References Cited

U.S. PATENT DOCUMENTS

| | | | |
|---|---|---|---|
| 3,525,317 | 8/1970 | Muir | 123/320 |
| 4,401,073 | 8/1983 | Furuhashi | 123/339 |
| 4,572,114 | 2/1986 | Sickler | 123/21 |
| 4,592,319 | 6/1986 | Meistrick | 123/321 |
| 4,640,241 | 2/1987 | Matsunaga | 123/198 F |
| 4,648,365 | 3/1987 | Bostelman | 123/321 |
| 4,655,187 | 4/1987 | Gravestock | 123/481 |
| 4,664,070 | 12/1987 | Meistrick et al. | 123/21 |
| 4,742,806 | 5/1988 | Tart, Jr. et al. | 123/322 |
| 4,966,110 | 10/1990 | Seki et al. | 123/321 X |

FOREIGN PATENT DOCUMENTS 0167267 1/1986 European Pat. Off. ..... 123/321

OTHER PUBLICATIONS

Lannan, Sisson, and Wolber, "Cummins Electronic Controls for Heavy Duty Diesel Engines", *IEEE* 88 CH2533-8 (Oct. 1988).

"Pace Subsystem Design Specification", Ellison et al. Sep. 17, 1985, p. 37.

"Pace Technical Package", Gatewood, pp. 6, 11 (no date given).

"Pace" (no author or date given).

*Primary Examiner*—Willis R. Wolfe

*Attorney, Agent, or Firm*—Woodard, Emhardt, Naughton, Moriarty & McNett

[57] ABSTRACT

An electronic microcomputer based engine brake control device and a method for controlling an engine compression brake is disclosed. An algorithm for enabling engine brake operation includes monitoring a brake enable switch, engine RPM, engine fueling rate, cruise control or power takeoff system activation state, throttle position, manifold pressure and clutch pedal position. Engine brake operation is fully automatic and operates in a safe manner according to the disclosed algorithm.

10 Claims, 3 Drawing Sheets

ENGINE BRAKE CONTROL APPARATUS AND METHOD

FIELD OF THE INVENTION

This invention relates generally to an improved engine brake control apparatus and method and more particularly to an electronic control unit for monitoring a variety of input signals corresponding to operating conditions and enabling engine brake operation only when the input signals meet predetermined conditions.

BACKGROUND OF THE INVENTION

Adequate and reliable braking for large vehicles, particularly tractor trailer vehicles, is assisted by devices known as engine brakes or engine compression brakes. An engine brake system utilizes the energy required to compress air in the cylinders of the engine to brake the vehicle. The drag put on the drive line by the engine when placed in the compression braking mode can serve to slow the vehicle more rapidly, when used in conjunction with the disc or drum brakes of the vehicle.

With the advent of electronic controls for use with internal combustion engines, the sophistication of control strategies increases. Specifically, when an engine control module or ECM is responsible for monitoring a host of parameters in supplying a variety of control signals to various devices, the ECM should prevent operation of engine compression braking when certain operating conditions exist.

One known engine brake controller device is shown in Meistrick et al., U.S. Pat. No. 4,664,070. The device disclosed therein includes a compression release-type engine retarder having a hydro-mechanical valve actuating mechanism operated by an electronic controller which responds to throttle position, actuation of the brake pedal, and other manual or automatic control or inputs. Other patents showing electrical controllers for operating compression release engine retarding systems include Meistrick, U.S. Pat. No. 4,592,319, and Sickler, U.S. Pat. No. 4,572,114.

Tart, Jr. et al., U.S. Pat. No. 4,742,806, discloses an engine braking system including an on/off switch and switches connected to other parameters such as clutch throttle position which, when in a favorable position, allow the system to operate, but when in an unfavorable position, the system is disabled. Furuhashi, U.S. Pat. No. 4,401,073, Matsunaga, U.S. Pat. No. 4,640,241, and Gravestock, U.S. Pat. No. 4,655,187 disclose electronic fuel control systems which include various inputs and outputs. Muir, U.S. Pat. No. 3,525,317, discloses a multiple-position switch actuated by a throttle pedal so that the position of the throttle pedal provides actuation in a multiple stage fashion of the engine compression braking system disclosed therein.

A control strategy for preventing operation of engine braking except when certain operating conditions and parameters are satisfied will provide more efficient and safer operation of engine braking.

SUMMARY OF THE INVENTION

A compression brake control device for use with a vehicle having an engine, a clutch, a transmission, a compression brake apparatus having a brake input and activated in response to signals supplied to the brake input, and a throttle control device, the brake control device according to one aspect of the present invention comprises fuel metering means for controlling fuel delivery to the engine, the fuel metering means including a fuel signal input, the fuel metering means supplying fuel to the engine in accordance with signals supplied to the fuel signal input, throttle position sensor means for sensing the position of the throttle control device, the throttle position sensor means producing a throttle signal corresponding to the position of the throttle control device, pressure sensor means in fluid communication with the intake manifold of the engine, the pressure sensor means producing a pressure signal corresponding to intake manifold pressure, control circuit means for supplying a fueling signal to the fuel signal input in accordance with the throttle signal, RPM sensor means for producing an RPM signal corresponding to engine RPM, and brake circuit means for supplying a braking signal to the brake input of the compression brake apparatus in accordance with concurrence of the following conditions: the RPM signal is greater than a predetermined RPM limit; the throttle signal is below a predetermined throttle limit; the fueling signal is below a predetermined fueling limit; and the pressure signal is below a predetermined pressure limit.

A method for activating and deactivating a compression brake in an internal combustion having a throttle control according to another aspect of the present invention includes the steps of (a) detecting a throttle control position below a predetermined throttle limit, (b) detecting an intake manifold pressure below a predetermined pressure limit, (c) detecting an engine speed above a predetermined RPM limit, (d) detecting a fuel metering signal corresponding to a fueling rate below a predetermined fueling limit, and activating the compression brake only when the conditions in steps (a), (b), (c), and (d) are concurrently satisfied.

One object of the present invention is to provide an improved engine brake control device.

Another object of the present invention is to provide an engine brake control device which monitors and senses a plurality of inputs and operating conditions and tests whether a predetermined combination of input conditions and operating conditions exist prior to activating the compression brakes.

A further object of the present invention is to provide safety lockout conditions for preventing activation of the engine brakes under certain circumstances wherein operation thereof would endanger the driver of the vehicle or other persons in nearby vehicles.

These and other objects of the present invention will become more apparent from the following description of the preferred embodiment.

DESCRIPTION OF THE PREFERRED EMBODIMENT

Figure 1:
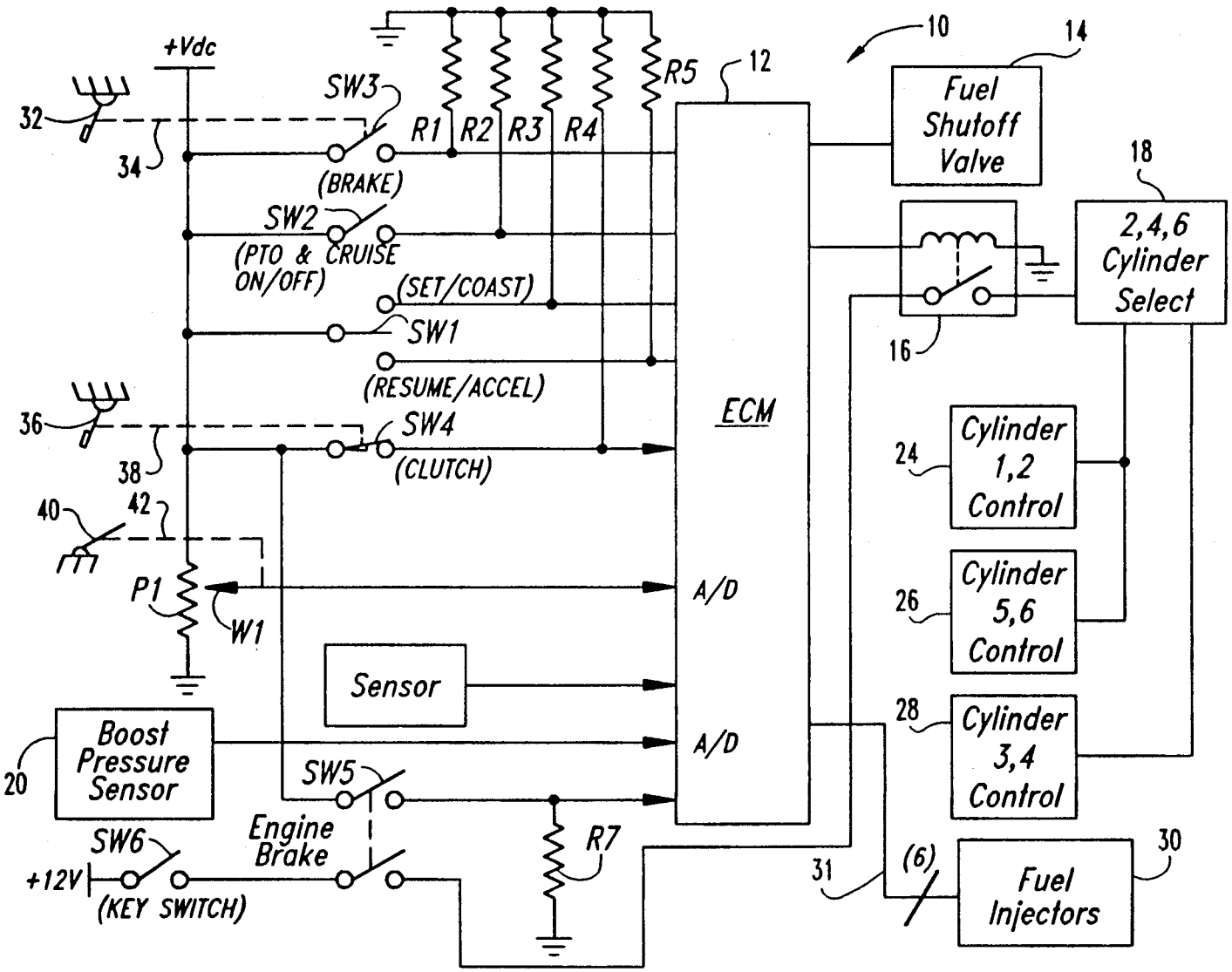
FIG. 1 is a schematic illustration of the engine brake control device according to the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, an engine brake control device 10 according to the present invention is shown. The engine brake control device 10 includes an engine control module or ECM 12. ECM 12 is a microcomputer including ROM, RAM, EEPROM, analog I/O and digital I/O. Connected to the ECM 12 are a variety of input and output devices which form a part of the engine control system. Devices which are controlled by ECM 12 include fuel shutoff valve 14, cylinder select device 18, engine brake relay 16, and fuel injectors 30. Cylinder control devices for activating compression braking of individual pairs of cylinders designated as blocks 24, 26 and 28 are indirectly controlled by ECM 12 when relay 16 is energized. A variety of input signals are supplied to digital and analog inputs of ECM 12, which inputs correspond to operating conditions of the vehicle. More particularly, switches SW1 and SW2 provide input signals to the ECM 12 representing the operator's request for power takeoff (PTO) and cruise control operation. Switch SW1 provides set/coast and resume/acceleration input signals while SW2 is the activation signal indicating that power takeoff operation or cruise control operation is desired. Switches SW1 and SW2 are dual function switches in that while the vehicle is moving down the road the switches act or function as cruise control operation switches, and while the vehicle is stationary and a particular fixed speed of engine operation is desired to run a power takeoff device, such as a cement mixer truck, the ECM 12 will determine that the vehicle is not moving and that the driver is requesting power takeoff operation rather than cruise control operation.

Switch SW3 is mechanically coupled to brake pedal 32 via linkage 34. Likewise, switch SW4 is mechanically coupled via linkage 38 to clutch pedal 36. Switches SW3 and SW4 supply logic signals to ECM 12 corresponding to the position of pedals 32 and 36, respectively. Accelerator pedal 40 is mechanically coupled to potentiometer P1 via linkage 42. Wiper W1 of potentiometer P1 is electrically connected to an analog to digital or A/D input of ECM 12. RPM and engine position sensor 22 includes a tone wheel or gear tooth detection sensor (a variable reluctance or Hall effect device sensor) and corresponding signal conditioning circuitry for producing a signal representative of engine RPM. The signal produced by RPM sensor 22 is an analog signal. Alternatively, the signal produced by sensor 22 may be a digital pulse train.

Boost pressure sensor 20 is mounted on the engine and in fluid communication with the intake manifold of the engine. Where a typical heavy duty truck engine includes a turbocharger for increasing intake manifold pressure, an intake manifold sensor or boost pressure sensor 20 is utilized to monitor one operating condition of the engine. The boost pressure sensor 20 produces an analog signal which is supplied to an A/D input of ECM 12. Engine brake switch SW5 is a double-pole, single-throw switch located in the driver's cab compartment. Switch SW5 provides two separate functions when actuated. First, switch SW5 provides an input signal to ECM 12 indicating that the driver of the vehicle desires engine brake operation. Additionally, switches SW5 and SW6, when enabled, supply power (12 VDC) to relay 16, and thus enable engine brake operation when ECM 12 has energized relay 16. As a further safeguard, switch SW6 is included in the system design to prevent activation of the cylinder select block 18 in the event the contacts of relay 16 become welded together and will not open. Thus, key switch SW6 prevents activation of cylinder select device 18.

Fuel injectors 30, of which there are six, are activated via six control signals represented by signal bus 31. Resistors R1–R5, and resistor R7 provide pull down functions well known in the art for maintaining the logic inputs of ECM 12 at a logic low state to prevent floating of the inputs of ECM 12 to a logic high state under high impedance conditions or switch "open" conditions.

Figure 2:
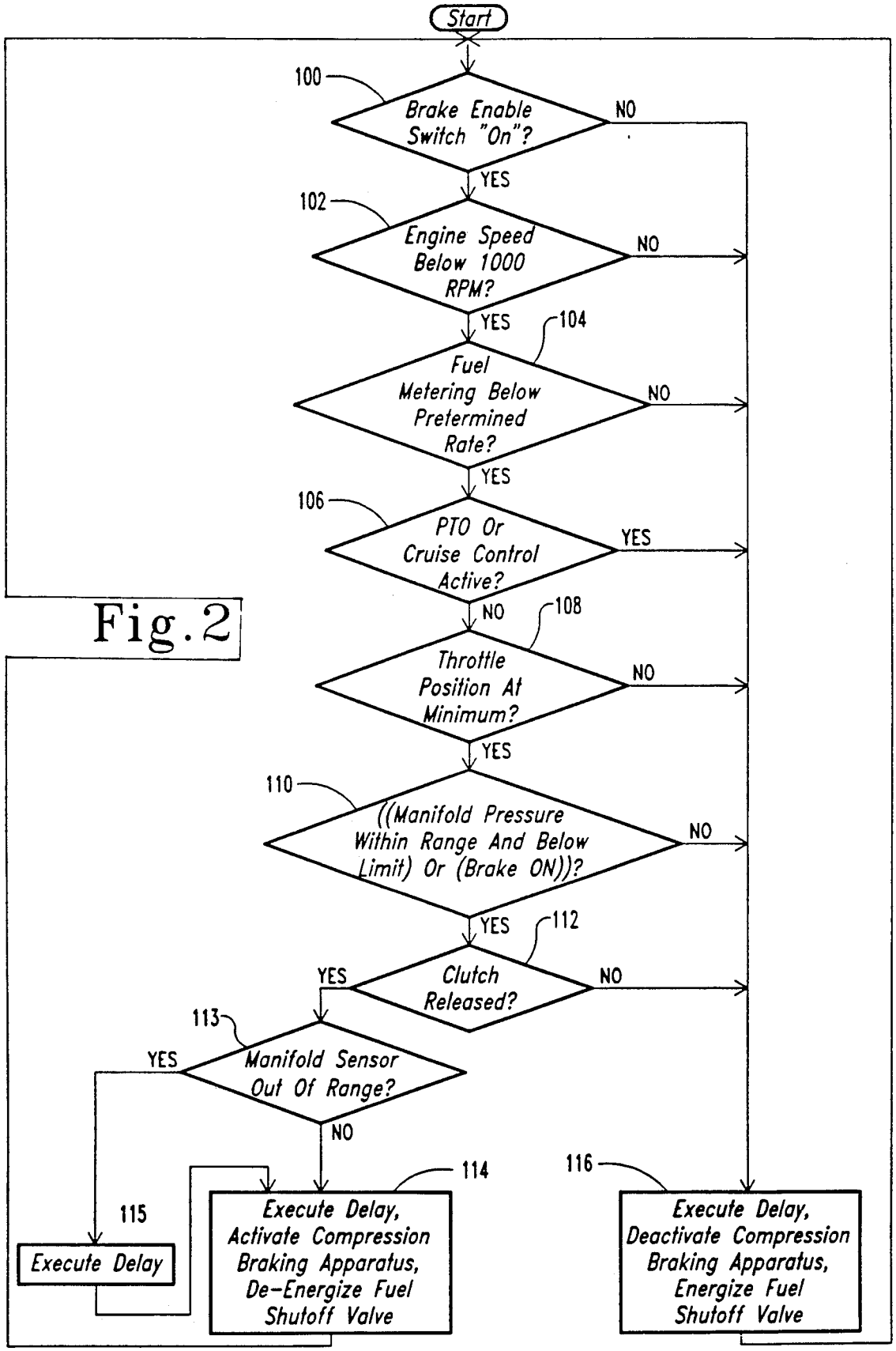
FIG. 2 is a flow-chart depicting a software algorithm for activation of an engine brake according to the present invention.

Referring now to FIG. 2, a flow-chart for the engine brake control algorithm according to the present invention is shown. ECM 12, in addition to its other functions of providing fuel injection signals to the fuel injectors 30 and monitoring other operating conditions of the vehicle, also is responsible for periodically monitoring the conditions associated with engine brake operation and activating the engine braking apparatus when certain predetermined conditions exist. Typically, ECM 12 executes the algorithm depicted in FIG. 2 many times a second so that a continuous monitoring of inputs and resulting control of outputs occurs in a real time fashion. Specifically, the algorithm for enabling engine brake operation includes monitoring the brake enable switch SW5 at step 100 for a request for engine brake operation. If the switch is on, or closed, then step 102 is next executed. However, if switch SW5 is open, program flow continues with step 116 where ECM 12 will deactivate the compression braking apparatus by de-energizing relay 16 and energize the fuel shutoff valve 14 to enable fuel to be supplied to the fuel injectors 30. At step 102, the engine speed as detected through sensor 22 is tested to see if it is above or below 1000 RPM. If below 1000 RPM, program execution will continue at step 104. If engine speed is above 1000 RPM (or an alternate yet suitable predetermine speed) at step 102, then program execution continues with step 116.

ECM 12 examines the contents of memory locations which correspond to the rate or level of fueling of the engine at step 104. The fueling rate data recalled from memory is indicative of and enables a determination of the duty cycle of the pulse width modulated signals supplied to the injectors 30. In particular, the fuel injectors 30 receives the pulse width modulated signals produced by ECM 12. If the pulse width modulated signals supplied to the fuel injectors 30 are all less than a predetermined duty cycle, i.e. such as an 8 percent or lower duty cycle signal, then program execution will continue at step 106. However, if the duty cycle of the fuel signals is greater than a predetermined duty cycle percentage, which may range anywhere from 8 to 22 percent or higher, then program execution will continue with step 116. At step 108, ECM 12 checks the throttle position via a test of the voltage from wiper W1, to determine if the throttle is at or below a predetermined minimum position corresponding to a predetermined voltage. If the sensed voltage at W1 is at or below a predetermined throttle minimum voltage then program execution continues at step 110. If the wiper W1 voltage is not at or below the throttle minimum voltage, i.e. the driver has depressed and displaced the accelerator pedal, then program execution continues with step 116. At step 110, ECM 12 checks the input signal from boost pressure sensor 20 to determine if the intake manifold pressure is within a predetermined range (a valid signal indicating the sensor is functioning properly) and below a predetermined pressure limit or if the engine brake is presently active or operating. If either or both of these logic conditions are satisfied, then program execution will continue at step 112. If neither of the dual conditions of step 10 are satisfied, then program execution continues with step 116. At step 112, ECM 12 monitors the input signal from switch SW4 to determine whether the driver of the vehicle has depressed the clutch pedal 36: If switch SW4 indicates the clutch pedal has been depressed, then program execution continues with step 116. If at step 112 the clutch is released, i.e. switch SW4 is closed, then program execution continues with step 113. At step 113, the signal from the intake manifold pressure sensor or boost sensor 20 is analyzed by ECM 12 for out of range conditions, i.e. the sensor is producing a signal indicative of a defective sensor. If the sensor 20 is producing an out of range signal, it is desired that engine braking remain operational if all other conditions in steps 100–112 are currently satisfied for engine brake operation. Therefore, if the sensor 20 signal is out of range, a predetermined "sensor defective" delay is executed by ECM 12 before program execution continues at step 114. Alternatively, if the sensor 20 signal is within a range which indicates the sensor if functioning normally, then program execution continues at step 114 after step 113. At step 114, ECM 12 delays a period of time before supplying a signal to relay 16 activating relay 16, and thus activating cylinder select device 18. Cylinder select device 18 controls cylinder control blocks 24, 26 and 28 to enable three separate levels of engine braking operation. Optionally, ECM 12 can deenergize fuel shutoff valve 14 at step 114 to prevent additional fuel from flowing to fuel injectors 30. If relay 16 is deenergized before execution of step 114, then ECM 12 delays activation of relay 16 at step 114 for a predetermined "activation" period of time (up to several seconds) to expend fuel in the system or engine after de-energizing valve 14. Similarly, when the state of relay 16 is changed from deenergized to energized, a predetermined "deactivation" time delay is executed by ECM 12 at step 116 after deactivating compression braking before valve 14 is energized to allow the vehicle brake hydraulics (not shown) to mechanically release the drive train before fueling begins. After steps 114 or 116, program execution continues with step 100 wherein the host of conditions necessary for engine braking operation are again checked. In this manner, an algorithm enabling engine brake operation is continuously operating and allows fully automatic operation or activation of the engine brakes which provides increased convenience to the driver of a heavy duty truck.

Figure 3:
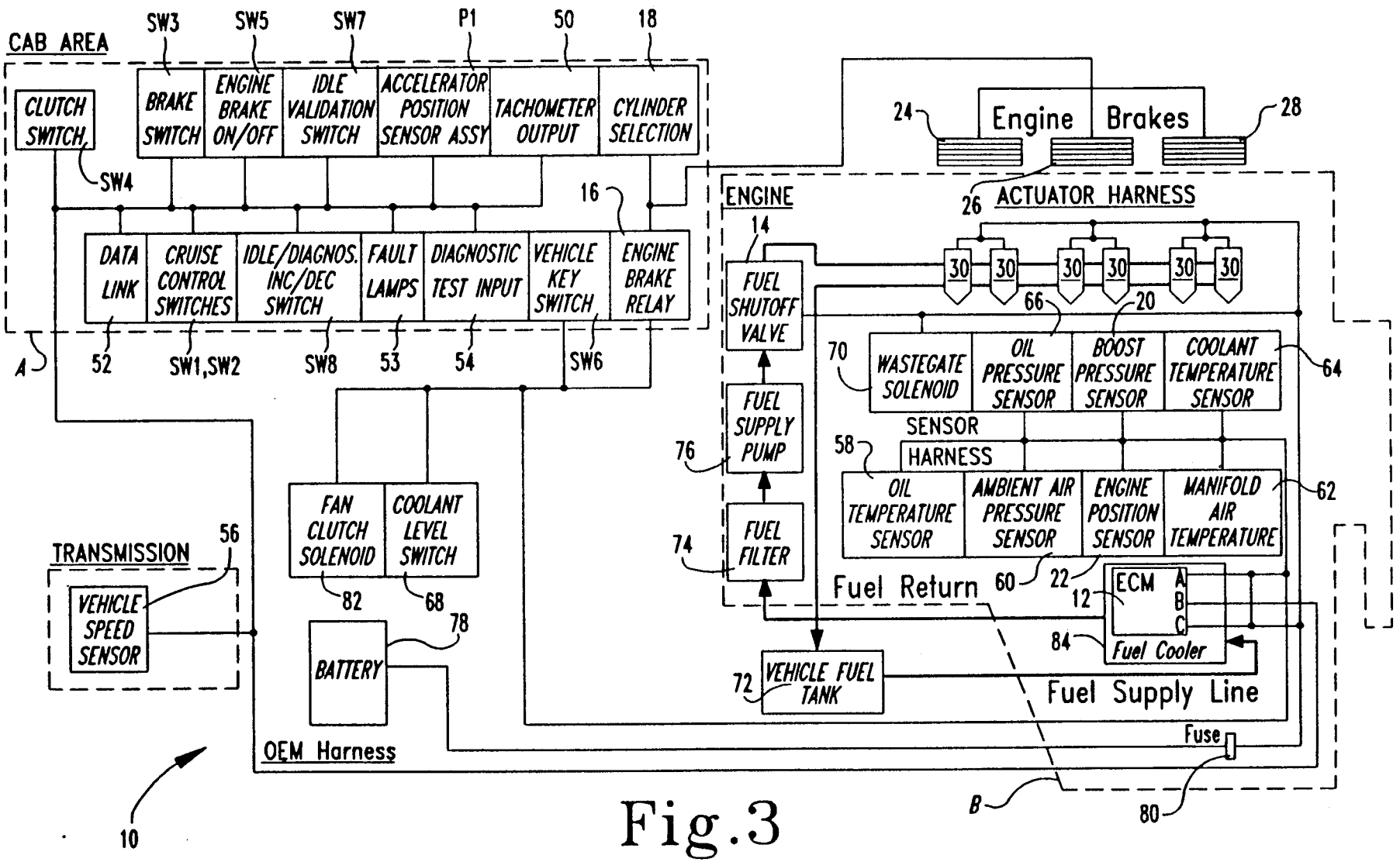
FIG. 3 is a block diagram of a complete electronic engine control system including an engine brake control device according to the present invention.

Referring now to FIG. 3, a more detailed block diagram of the engine brake control device 10 according to the present invention is shown. Like components of FIG. 1 are identified with like designations in FIG. 3. System componentry located in the cab area A includes clutch switch SW4, brake switch SW3, engine brake on/off switch SW5 and cruise control switches SW1 and SW2. Accelerator position sensor assembly P1 corresponds with potentiometer P1 of FIG. 1. Vehicle key switch SW6 is also shown. Cylinder selection device 18 and engine brake relay 16 are also shown located in the cab area A while cylinder control devices 24, 26 and 28 are attached to the engine (indicated by broken line B). In addition, other components of this system include an idle validation switch SW7 and an idle/diagnostics INC/DEC switch SW8. A tachometer output 50 is provided in the cab area as well as a data link 52 which enables connection to an external diagnostics device. Fault lamps 53 provide an indication to the driver of various engine operating or fault conditions detected by ECM 12. A diagnostic test input 54 is also provided in the cab area for entering input information with regard to diagnostics.

Systems closely associated with and attached to the engine of the vehicle are contained within the broken line B. Sensors which provide operating condition information to ECM 12 include boost pressure sensor 20, engine speed/position sensor 22, vehicle speed sensor 56, oil temperature sensor 58, ambient air pressure sensor 60, manifold air temperature sensor 62, coolant temperature sensor 64, oil pressure sensor 66, and coolant level switch 68.

Device which are subject to control by ECM 12 include wastegate solenoid 70, fuel shutoff valve 14, and fuel injectors 30. Also shown are a vehicle fuel tank 72, a fuel filter 74, a fuel supply pump 76, a battery 78, a fuse 80, and fan clutch solenoid 82 controlled by ECM 12. Lastly, ECM 12 is located within fuel cooler 84 to provide a temperature controlled environment for ECM 12.

The system depicted in FIG. 3 corresponds with the electronic controls designed and manufactured by Cummins Electronics and Cummins Engine of Columbus, Ind. The device 10 is sold and marketed under the trade name CELECT by Cummins Engine.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A compression brake controller for use with a vehicle having an engine, a clutch, a transmission, a compression brake apparatus having a brake input and activated in response to signals supplied to said brake input, and a throttle control device, said compression brake controller comprising:

fuel metering means for controlling fuel delivery to said engine, said fuel metering means including a fuel signal input, said fuel metering means supplying fuel to said engine in accordance with signals supplied to said fuel signal input;

throttle position sensor means for sensing the position of the throttle control device, said throttle position sensor means producing a throttle signal corresponding to the position of the throttle control device;

pressure sensor means in fluid communication with the intake manifold of the engine, said pressure sensor means producing a pressure signal corresponding to intake manifold pressure;

control circuit means for supplying a fueling signal to said fuel signal input in accordance with said throttle signal;

RPM sensor means for producing an RPM signal corresponding to engine RPM; and brake circuit means for supplying a braking signal to the brake input of the compression brake apparatus in accordance with concurrence of the following conditions:

said RPM signal is greater than a predetermined RPM limit;

said throttle signal is below a predetermined throttle limit;

said fueling signal is below a predetermined fueling limit; and said pressure signal is below a predetermined pressure limit.

2. The controller of claim 1 including:

clutch position sensor means for producing a clutch engaged signal when said clutch is positioned to supply power from the engine to the transmission; and wherein said brake circuit means produces said braking signal only when said clutch engaged signal is also present.

3. The controller of claim 2 including switch means for producing an enable signal in response to a driver request for compression brake operation, and wherein said brake circuit means produces said braking signal only when said enable signal is also present.

4. The controller of claim 3 including means for sensing PTO operation status and producing a PTO inactive signal when said PTO is disabled, and wherein said brake circuit means produces said breaking signal only when said PTO inactive signal is also present.

5. The controller of claim 4 wherein the vehicle includes a cruise control device and said brake controller further includes means for detecting cruise control operation and producing a cruise control inactive signal when said cruise control device is not active, and wherein said first circuit means produces said braking signal only when said cruise inactive signal is also present.

6. The controllers of claim 1 or 5 including means for delaying interposed between said brake circuit means and said brake input, said means for delaying introducing a predetermined activation time delay when said braking signal is produced, said means for delaying also introducing a predetermined deactivation time delay when said braking signal expires.

7. The controller of claim 6 including fuel shutoff means having a fuel shutoff input for interrupting fuel flow, said fuel shutoff means allowing fuel to flow from a source of fuel to said fuel metering means, wherein said braking signal is supplied to said fuel shutoff input and said fuel shutoff means interrupts the supply of fuel to said fuel metering means when said braking signal is present.

8. The controller of claim 7 wherein said control circuit means and said brake circuit means are integral parts of a microcomputer having a CPU, RAM, ROM, and I/O capability.

9. A method for activating and deactivating a compression brake in an internal combustion having a throttle control, said method comprising the steps of:

(a) detecting a throttle control position below a predetermined throttle limit;

(b) detecting an intake manifold pressure below a predetermined pressure limit;

(c) detecting an engine speed above a predetermined RPM limit;

(d) detecting a fuel metering signal corresponding to a fueling rate below a predetermined fueling limit; and activating said compression brake only when the conditions in steps (a), (b), (c), and (d) are concurrently satisfied.

10. The method of claim 9 including the steps of:

(e) detecting a brake enable switch state indicating a request for compression brake operation; and activating said compression brake only when the conditions in steps (a)-(e) are currently satisfied.

* * * * *